US008192209B1

(12) United States Patent
Li et al.

(10) Patent No.: US 8,192,209 B1
(45) Date of Patent: Jun. 5, 2012

(54) SURFACE MOUNT CLIP FOR ROUTING AND GROUNDING CABLES

(75) Inventors: Chris T. Li, Fremont, CA (US); Steven Chase, Cupertino, CA (US)

(73) Assignee: Amazon Technologies, Inc., Reno, NV (US)

( * ) Notice: Subject to any disclaimer, the term of this patent is extended or adjusted under 35 U.S.C. 154(b) by 0 days.

(21) Appl. No.: 12/351,663

(22) Filed: Jan. 9, 2009

(51) Int. Cl.
*H01R 13/648* (2006.01)

(52) U.S. Cl. ..... 439/98; 174/40

(58) Field of Classification Search ..... 174/40; 439/98

See application file for complete search history.

(56) References Cited

U.S. PATENT DOCUMENTS

| | | | | |
|---|---|---|---|---|
| 3,383,457 | A * | 5/1968 | Schumacher et al. | 174/261 |
| 3,549,787 | A * | 12/1970 | Churla, Jr. | 174/78 |
| 4,637,669 | A | 1/1987 | Tajima | |
| 5,092,795 | A | 3/1992 | Kitagawa | |
| 5,207,597 | A | 5/1993 | Kline et al. | |
| 5,397,250 | A | 3/1995 | Briones | |
| 5,401,192 | A | 3/1995 | Briones et al. | |
| 5,949,020 | A * | 9/1999 | Mitchell et al. | 174/40 CC |
| 6,050,854 | A | 4/2000 | Fang et al. | |
| 6,132,253 | A | 10/2000 | Wu | |
| 6,190,205 | B1 | 2/2001 | Wu | |
| 6,319,061 | B1 | 11/2001 | Chen et al. | |
| 6,343,941 | B1 | 2/2002 | Kan | |
| 6,343,956 | B2 | 2/2002 | Stickney | |
| 6,368,154 | B1 | 4/2002 | Hirata et al. | |
| 6,478,622 | B1 | 11/2002 | Hwang | |
| 6,482,044 | B1 | 11/2002 | Ma et al. | |
| 6,582,240 | B2 | 6/2003 | Suto | |
| 6,773,275 | B1 | 8/2004 | Chen | |
| 7,044,791 | B2 | 5/2006 | Wang | |
| 7,371,084 | B2 | 5/2008 | Xue et al. | |
| 7,473,127 | B2 | 1/2009 | Wang et al. | |
| 7,530,845 | B1 | 5/2009 | Yang | |
| 7,608,782 | B2 * | 10/2009 | Hill | 174/84 C |
| 7,686,646 | B2 | 3/2010 | Lee et al. | |
| 7,708,600 | B2 | 5/2010 | Wu | |
| 2008/0266198 | A1 * | 10/2008 | Walker et al. | 343/846 |

* cited by examiner

*Primary Examiner* — Truc Nguyen
(74) *Attorney, Agent, or Firm* — Lee & Hayes, PLLC

(57) ABSTRACT

Disclosed is a clip is for routing and grounding a coaxial cable on a printed circuit board. The clip may be mechanically and electrically engaged to the printed circuit board and may be comprised of a resilient and conductive material. The clip engages and retains the coaxial cable and establishes an electrical connection between the coaxial cable and the printed circuit board. A sheath may be placed around a portion of the coaxial cable to engage the clip.

21 Claims, 12 Drawing Sheets

SURFACE MOUNT CLIP FOR ROUTING AND GROUNDING CABLES

BACKGROUND

Coaxial cables are present in a wide variety of electronic devices. Frequently, coaxial cables carry radio frequency (RF) signals from RF modules to antennas in an electronic device.

Changes in the physical routing of coaxial cabling along a backplane, such as a printed circuit board, can affect the electrical characteristics, such as impedance, of the coaxial cabling or adjacent components or both. Maintaining an intended arrangement of the physical routing of coaxial cabling during and after assembly produces an electronic device which performs as engineered.

Shrinking devices and use of surface mount technology has rendered routing coaxial cable runs within electronic devices more critical. Many small form factor devices such as e-book readers, cellular telephones, portable media players, laptops, netbooks, and the like, utilize coaxial cables.

However, the low profile and volumetric confines of these small form factor devices, combined with the small diameters of coaxial cable used, makes establishing coaxial cable routing during assembly a challenge.

In addition to maintaining the physical routing of the coaxial cabling, proper grounding of the coaxial cable poses further challenges in electronic devices. Improper, erratic, or incomplete grounding of coaxial cable can result in electromagnetic interference between components in the device, adversely affecting performance.

Effectively grounding coaxial cable during assembly can be particularly difficult given the small size of surface mount devices and the small diameter of coaxial cable often used. For example, grounding by soldering a shield of the coaxial cable to a printed circuit board is difficult, expensive in time and labor, and likely to damage the coaxial cable. Desoldering or cutting is required during subsequent removal of the coaxial cable.

Thus, surface mount electronic devices which use coaxial cabling pose special challenges in physical routing and grounding during assembly and repair.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
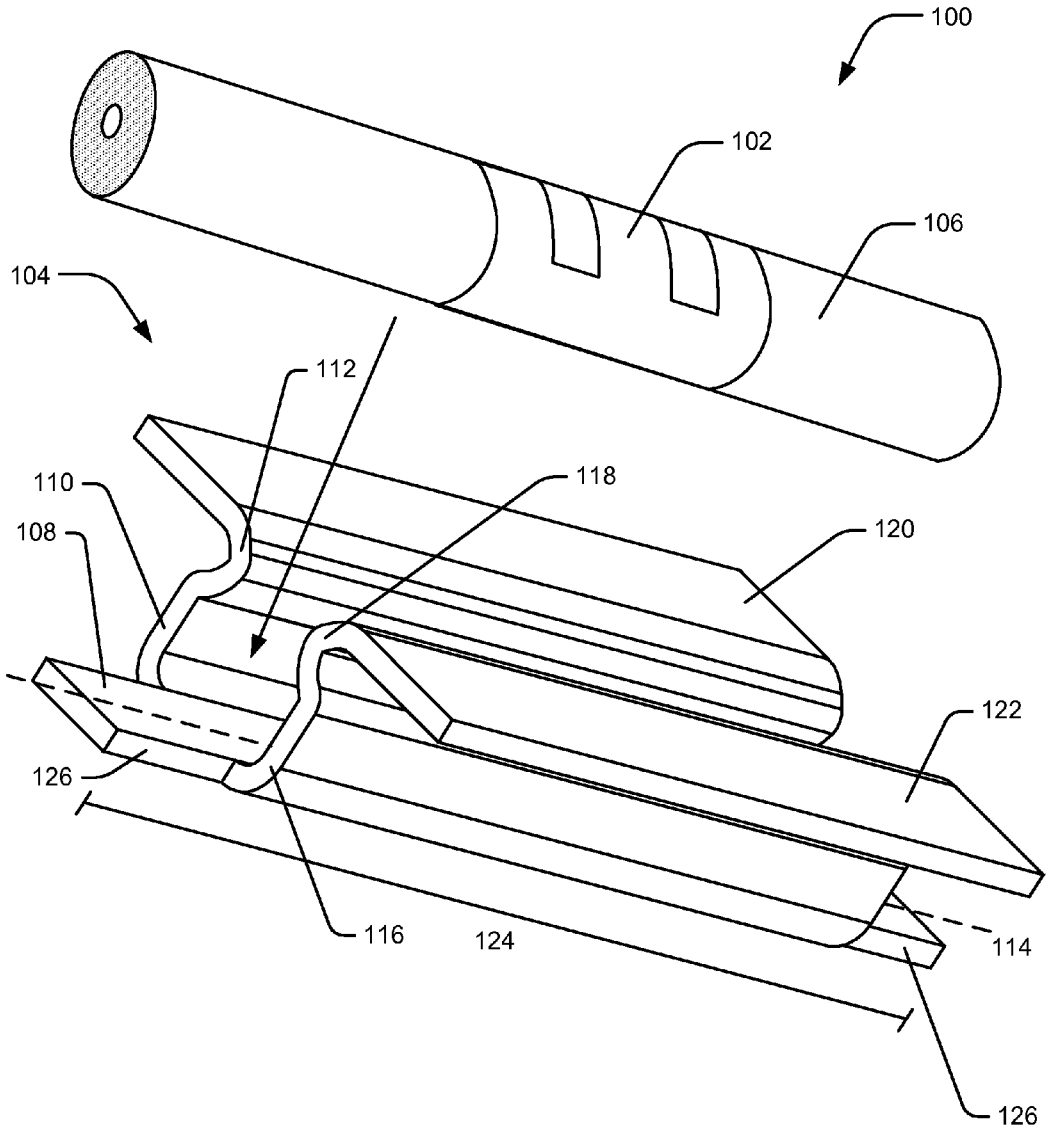
FIG. 1 shows an illustrative surface-mount grounding system configured to retain and ground a cable.

As discussed above, maintaining an intended route of a coaxial cable along a backplane and properly grounding the coaxial cable produces an electronic device which performs as engineered. However, the low profile and limited volume in small form factor devices makes routing and grounding small diameter coaxial cable on a backplane difficult. The surface-mount grounding system described herein maintains a desired routing of coaxial cable along a backplane in an electronic device, and provides an electrical ground connection for the coaxial cable. In one illustrative example, a surface mount clip affixed to a backplane positively engages a sheath affixed to a coaxial cable to route and ground the coaxial cable.

The sheath body may be circular in cross section, and maybe affixed circumferentially to a coaxial cable. The sheath may be affixed to the coaxial cable by crimping, adhesive, or a latch integral to the sheath body. The sheath may include a tooth or an edge to pierce or break the coaxial cable external insulation and contact the coaxial cable shield. For example, if attached by crimping, the sheath may break the insulation on insulated coaxial cable during crimping to contact the coaxial cable shield. In other implementations, surface-mount grounding systems may be provided that omit the sheath altogether. In that case, the clip retains and grounds the cable directly.

In one specific example, an electronic device such as an e-Book reader may utilize an antenna to radiate and receive radio signals. A coaxial cable may connect the RF module and the antenna. Within the e-Book reader, a printed circuit board (PCB) has surface mount electronic components affixed. One or more clips soldered to the PCB along an intended path of the coaxial cable define the route of the coaxial cable. Soldering aids in the electrical connection to the electrical ground on the PCB required for grounding. The coaxial cable used to connect the RF module and the antenna has sheaths attached on the cable to correspond to the location of the clips. One end of the coaxial cable may be connected to the RF module, for example, via solder or a connector. The coaxial cable may be laid along the predetermined route, and the sheaths can then be pushed into the clips, mechanically and electrically engaging the coaxial cable and clip via the sheath. The other end of the coaxial cable may then be connected to the antenna, for example via solder or a connector. Installation is thus quicker, and during service removal of the coaxial cable without desoldering or cutting at the grounding points is possible.

While coaxial cable is discussed, the described device and method may be used for other types of cabling, such as a single wire, a multiconductor cable with a circular cross section, or a multiconductor ribbon cable with a rectangular cross section. For cable types with non-circular cross sections, the sheaths and/or clips may have alternate designs, as described above with reference to FIG. 1.

While describe in the context of coaxial cable and printed circuit boards, the system is applicable to routing and grounding other cables to other types of backplanes.

Sheath and Clip Design

FIG. 1 shows a surface-mount routing and grounding system 100 utilizing a sheath 102 and a clip 104. The sheath 102 is engaged circumferentially around a coaxial cable 106. Alternatively, a sheath may engage part of the circumference of the coaxial cable 106 and utilize teeth or friction or adhesive or a combination of these to maintain engagement. The sheath may be comprised of material including metal (for example, aluminum, nickel silver, beryllium copper, etc.), non-conducting polymer (for example, polyvinyl chloride, poly(tetrafluoroethene), etc.), conducting polymer (for example, polyaniline, poly(3-alkylthiophenes, etc.), or combinations thereof. Plating non-conductive material with conductive material is also possible. The sheath may be straight or curved as desired to assist in achieving the desired routing. A sheath may also allow routing and grounding of non-coaxial cables by adapting to their distinctive cross sections. A sheath having a square or rectangular cross section may accommodate other cable types, including ribbon cable.

The clip 104 is capable of accepting and engaging a sheath, such as sheath 102. The clip 104 may be comprised of any of the materials described above for the sheath. As for the clip, where the material is non-conductive but conductivity is desired, the clip may be plated with a conductive material.

In the implementation of FIG. 1, clip 104 has a substantially rectangular bottom surface 108. Distal to the bottom surface 108 on a vertical left side 110, a left inward bend ridge 112 extends inward towards the centerline 114. Distal to the bottom surface 108 on a vertical right side 116, a right inward bend ridge 118 extends inward towards a centerline 114. Inward bend ridges 112 and 118 retain the sheath 102 within the body of the clip when engaged.

Extending away from the centerline 114 at the left and right inward bend ridges are top flanges 120 and 122, respectively. Top flanges 120 and 122 are substantially parallel to the bottom surface 108 and extend away from the centerline 114 of the clip 104. The top flanges 120 and 122 protect the coaxial cable 106 from inadvertent crushing during assembly, as well as provide a useable surface for automated equipment such as pick-and-placement machines to retrieve the clip 104. The bottom surface 108 may extend a length "L" 124 along the centerline 114 beyond front and back vertical edges of the vertical sides 110 and 116 to form tabs 126. These tabs 126 provide for easier access when soldering or otherwise affixing the clip 104 to a backplane (not shown). A backplane as used herein includes a printed circuit board, housing, or other mounting surface.

Use of a clip, such as clip 104, to attach and ground a cable to a backplane allows installation of the cable without manually soldering, which is time intensive, expensive, and prone to damage the cable. Also, using such a clip facilitates removal and reinstallation of the cable if necessary during assembly or repair as no desoldering or cutting is necessary for removal from the clip. Also, desired routing and grounding of the cable is more easily achieved and reproducible using the clip compared to direct soldering of the board due to the clip being affixed to the board prior to installation of the coaxial cable. When sheaths are used, the sheaths further aid in the routing and grounding for the cable, because the sheaths define locations at which the clip retains the cable. That is, sheaths serve as locating means along the cable to indicate which points of the cable engage with the clip.

The clip may also accept a coaxial cable 106 which does not have a sheath, or has a non-conductive sheath. When grounding an insulated coaxial cable with a non-conductive sheath or without a sheath, teeth may be present along the bottom surface 108 of the clip 104, left side 110, right side 116, or on the face of the left inward bend ridge 112 or right inward bend ridge 118, or any suitable combination thereof, to pierce the sheath, insulation, or both and establish an electrical connection.

Figure 2:
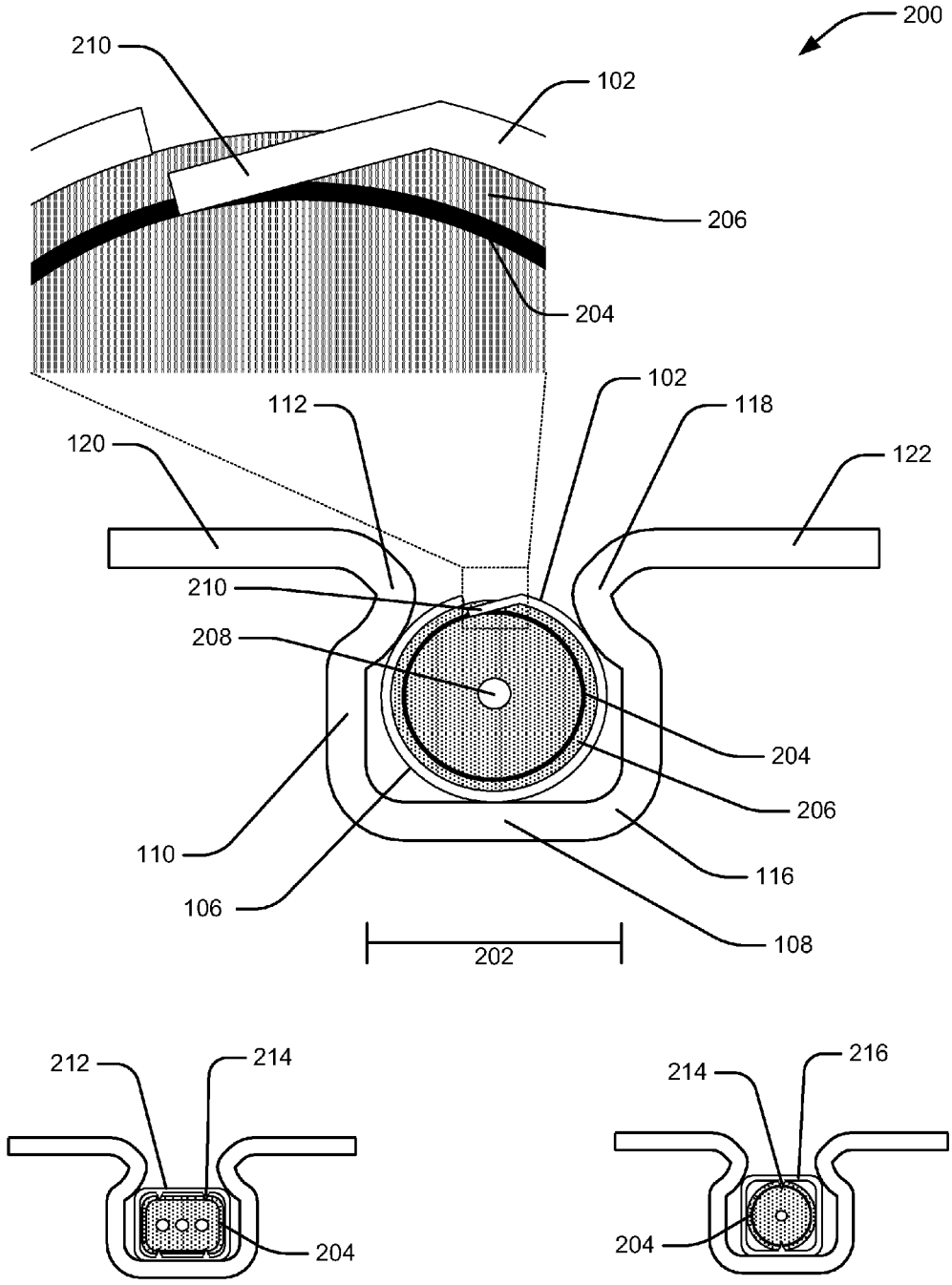
FIG. 2 shows a cross section of the illustrative clip of the surface-mount grounding system of FIG. 1 receiving a cable sheath.

FIG. 2 shows a cross section 200 of the clip 104, taken perpendicular to the centerline 114 of the clip in FIG. 1, with coaxial cable 106 engaged within the sheath 102 and engaged within clip 104. The coaxial cable 106 comprises an outer layer of insulation 206, disposed around a conductive shield 204, which is in turn disposed around another layer of insulation 206 with one or more internal conductors 208 within. The sheath 102 engages a portion of the coaxial cable 106 such that a portion 210 of the sheath 102 electrically engages the shield 204. While the sheath 102 is shown with a generally circular or elliptical cross section, the sheath may also have a substantially square or substantially rectangular cross section. For example, a rectangular cross section sheath 212 may be used. Protrusions 214 may be configured to pierce the insulation and engage the shield beneath. A square cross section sheath 216 is also shown. As noted above, the body has a horizontal bottom surface 108 and a vertical left side 110 and a vertical right side 116. The body of the clip 104 positively retains the sheath 102. Specifically, the sheath 102 is engaged by the left inward bend ridge 112 and right inward bend ridge 118, which defines a gap with wide "W" 202 smaller in diameter than the sheath 102. Width "W" 202 deforms to accept the diameter of the sheath and contract to retain the sheath 102. Alternatively, as mentioned above, the clip 104 may directly engage and retain the coaxial cable 106 without a sheath.

Figure 3:
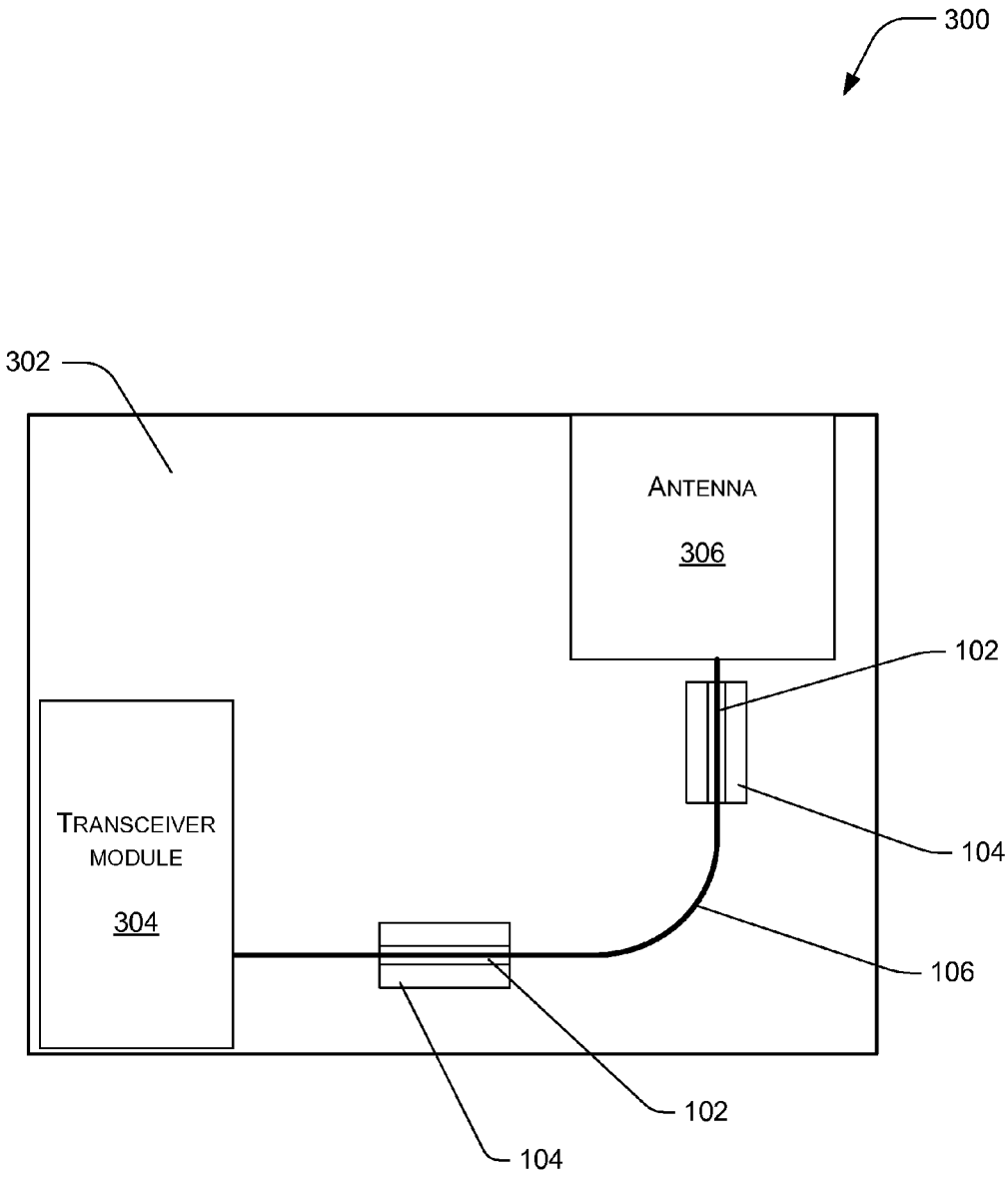
FIG. 3 shows an illustrative diagram of a printed circuit board utilizing the surface-mount grounding system of FIG. 1.

FIG. 3 shows an illustrative diagram of a printed circuit board 302 utilizing the above described sheath 102 and clip 104. Sheath 102 and clip 104 route coaxial cable 106 along an intended path on the PCB 302 from transceiver module 304 to antenna 306. The clips 104 also ground the coaxial cable 106 against the PCB 302.

Other Clip Designs

Figure 4:
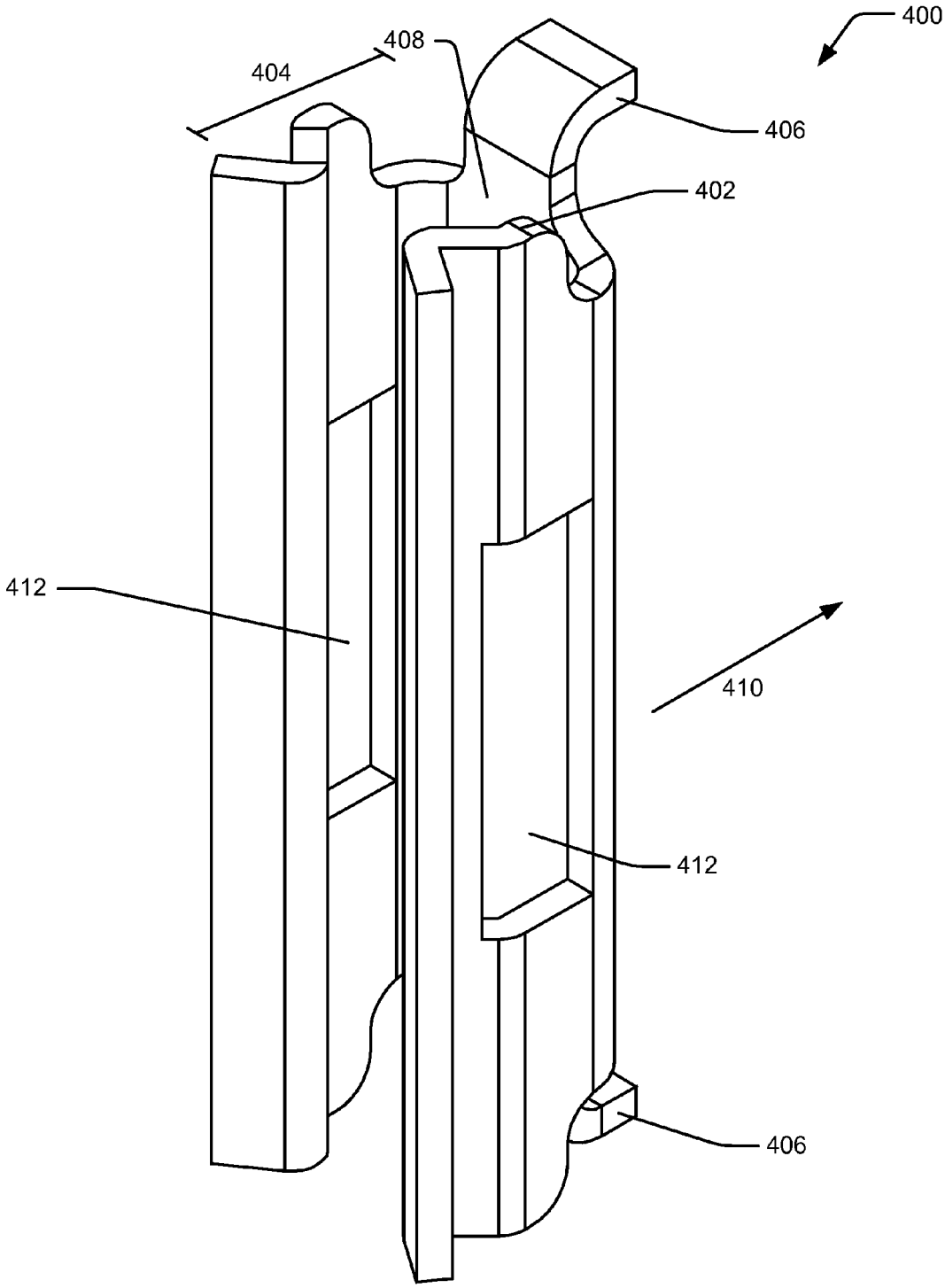
FIG. 4 shows another illustrative implementation of a clip which includes mounting tabs and relief holes.

FIG. 4 shows another illustrative implementation of a clip 400 usable with a surface-mount grounding system. The clip 400 of this implementation has a slightly rounded cross section 402. The slightly rounded portion achieves more contact with the sheath than a rectangular cross section, and also reduces the height "H" 404 of the clip. This reduction in height may be valuable in very low profile applications. On each end of the clip 400, a tab 406 extends away from the bottom surface 408, towards the backplane along arrow 410. The configuration of the tabs extending along the centerline in any of the clips disclosed herein may bend towards the backplane as shown in FIG. 4, or be straight as depicted in FIG. 1.

A relief hole 412 may be present in the left or right or both sides of the clip 400 to permit easier insertion of the sheath 102. Any of the clips or sheaths disclosed herein may have, or omit, relief holes.

Figure 5:
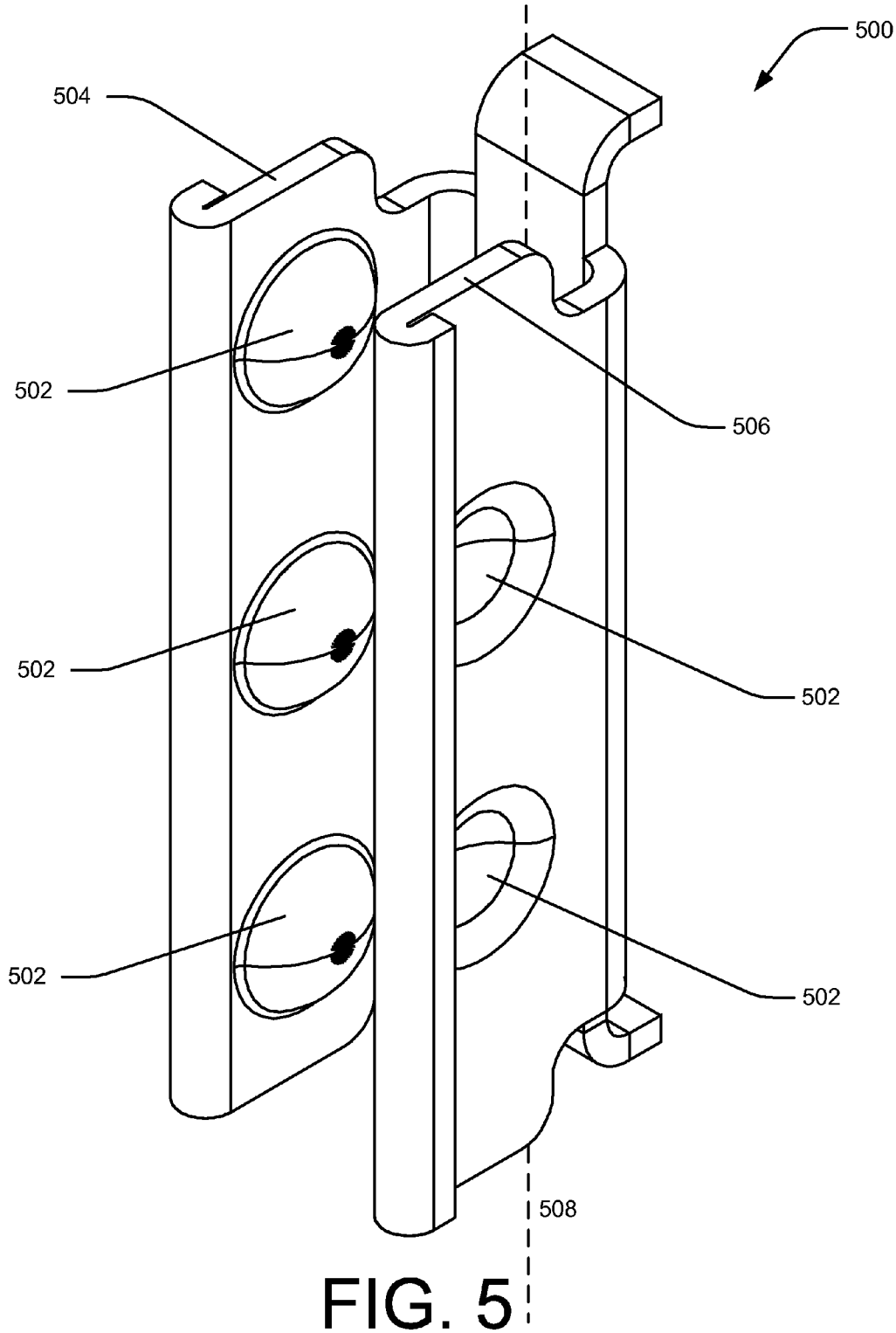
FIG. 5 shows another illustrative implementation of a clip which uses dimples on the sides to retain the sheath.

FIG. 5 shows another illustrative implementation of a clip 500 usable with a surface-mount grounding system. Clip 500 retains the sheath 102 using an arrangement of dimples 502 which protrude from the left side wall 504 and right side wall 506 towards the centerline 508 of the body of the clip. The dimples 502 may be aligned or offset relative to the dimples on the opposing wall. The top edges 510 have been rolled to facilitate human handling by removing a sharp edge which could cut, as well as by adding structural rigidity. Edges of any of the other clips described herein may be rolled.

Figure 6:
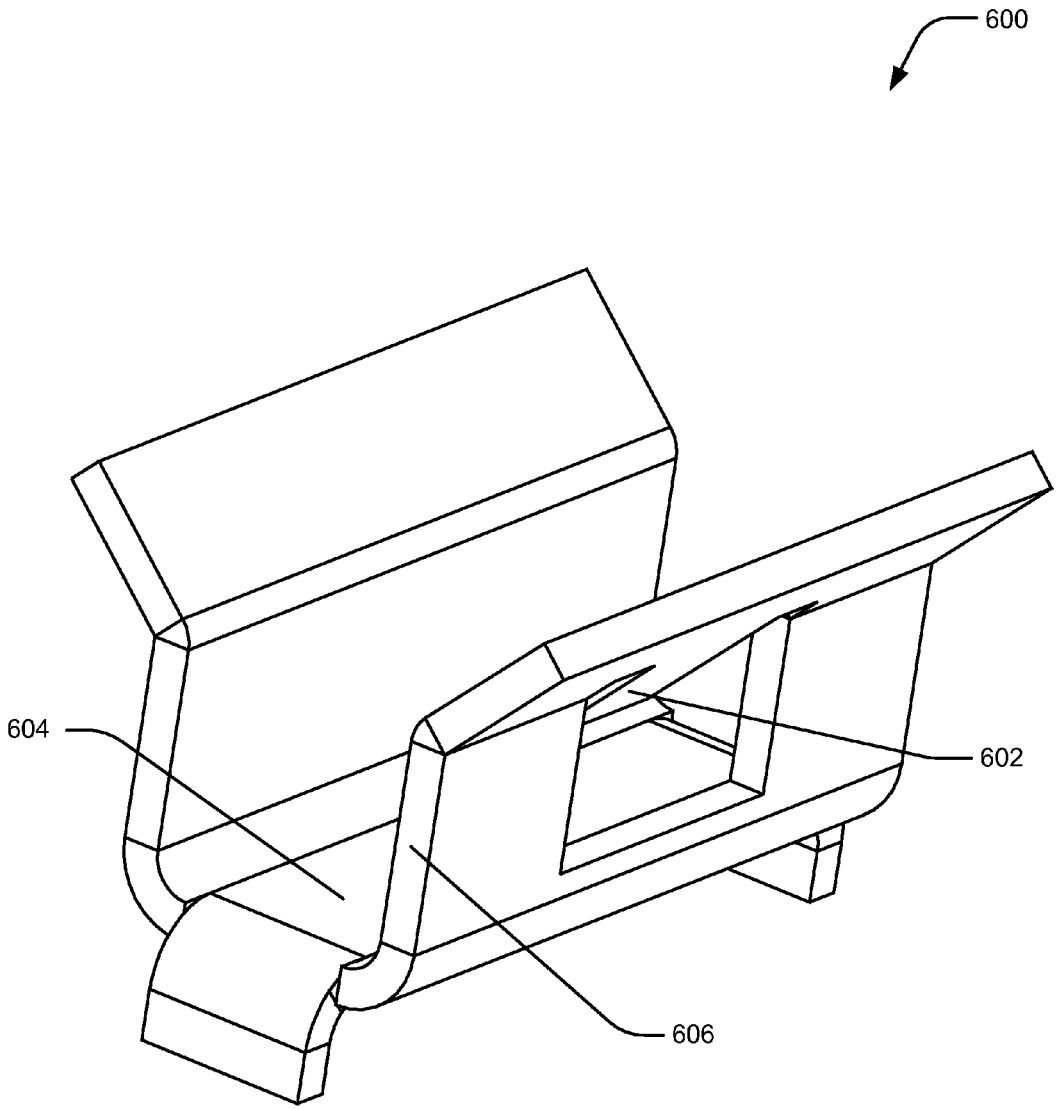
FIG. 6 shows another illustrative implementation of a clip which uses a flange extending from one side wall towards the centerline to retain the sheath.

FIG. 6 shows another illustrative implementation of a clip 600 usable with a surface-mount grounding system. Clip 600 retains the sheath 102 using a protrusion 602 which extends at an angle downward toward a bottom surface 604 from one side wall 606. Protrusion 602 stabs down into the cable producing affirmative engagement of the clip to the sheath. Protrusions may be tabs, planar members, spikes, fingers, extrusions, etc.

Figure 7:
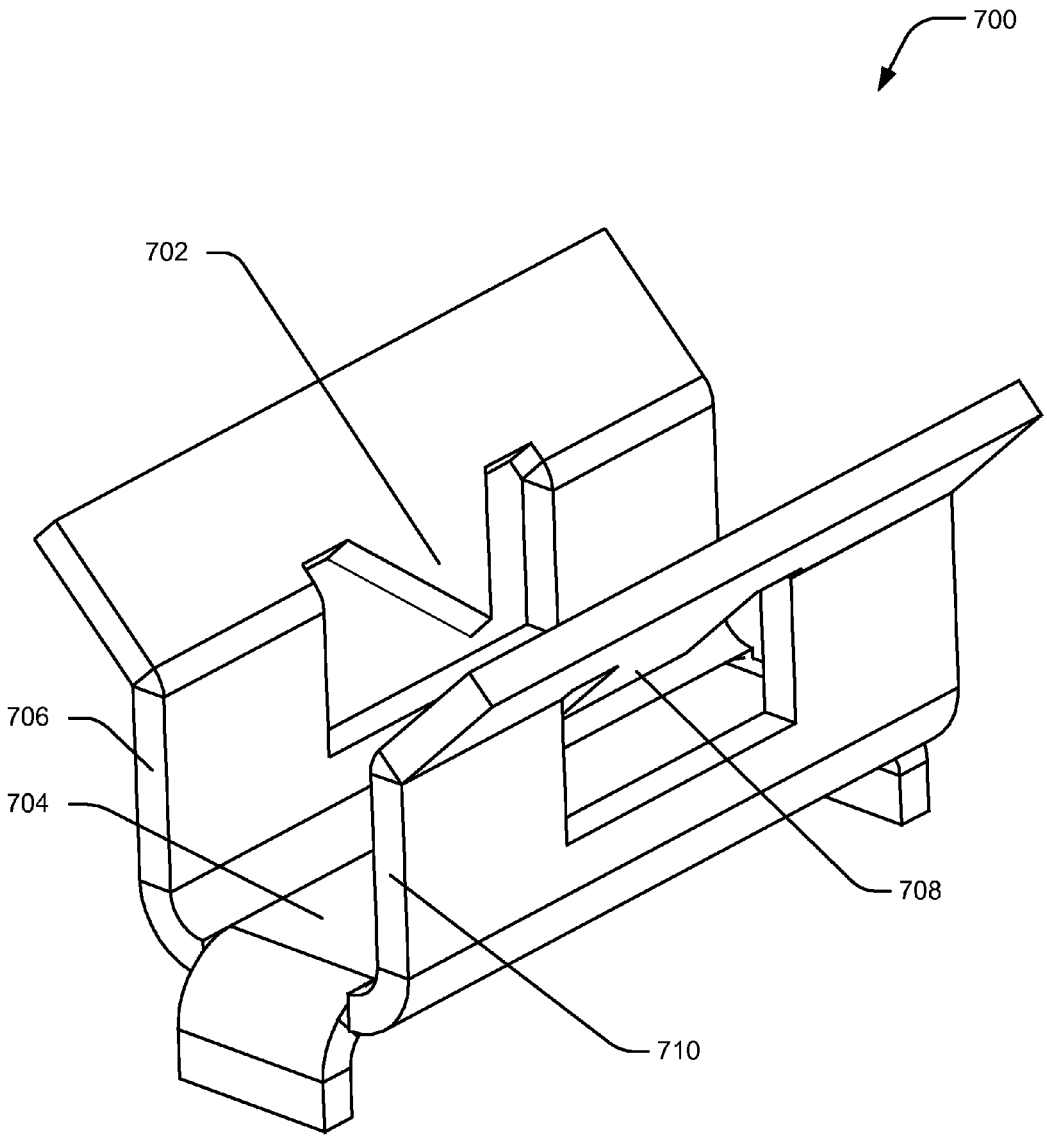
FIG. 7 shows another illustrative implementation of a clip which uses a flange extending from each side wall towards the centerline to retain the sheath.

FIG. 7 shows another illustrative implementation of a clip 700 usable with a surface-mount grounding system. Clip 700 retains the sheath 102 using a pair of protrusions. One protrusion 702 extends at an angle downward toward a bottom surface 704 from left side wall 706. Protrusion 702 may form a tooth or other cutting feature to pierce the insulation of the cable and a sheath, if present, to establish an electrical connection between the clip 700 and the cable. Another protrusion 708 extends at an angle downward toward the bottom surface 704 from right side wall 710. A more secure engagement of the clip to the sheath may be realized because the protrusions 702 and 708 stab down into the cable.

Figure 8:
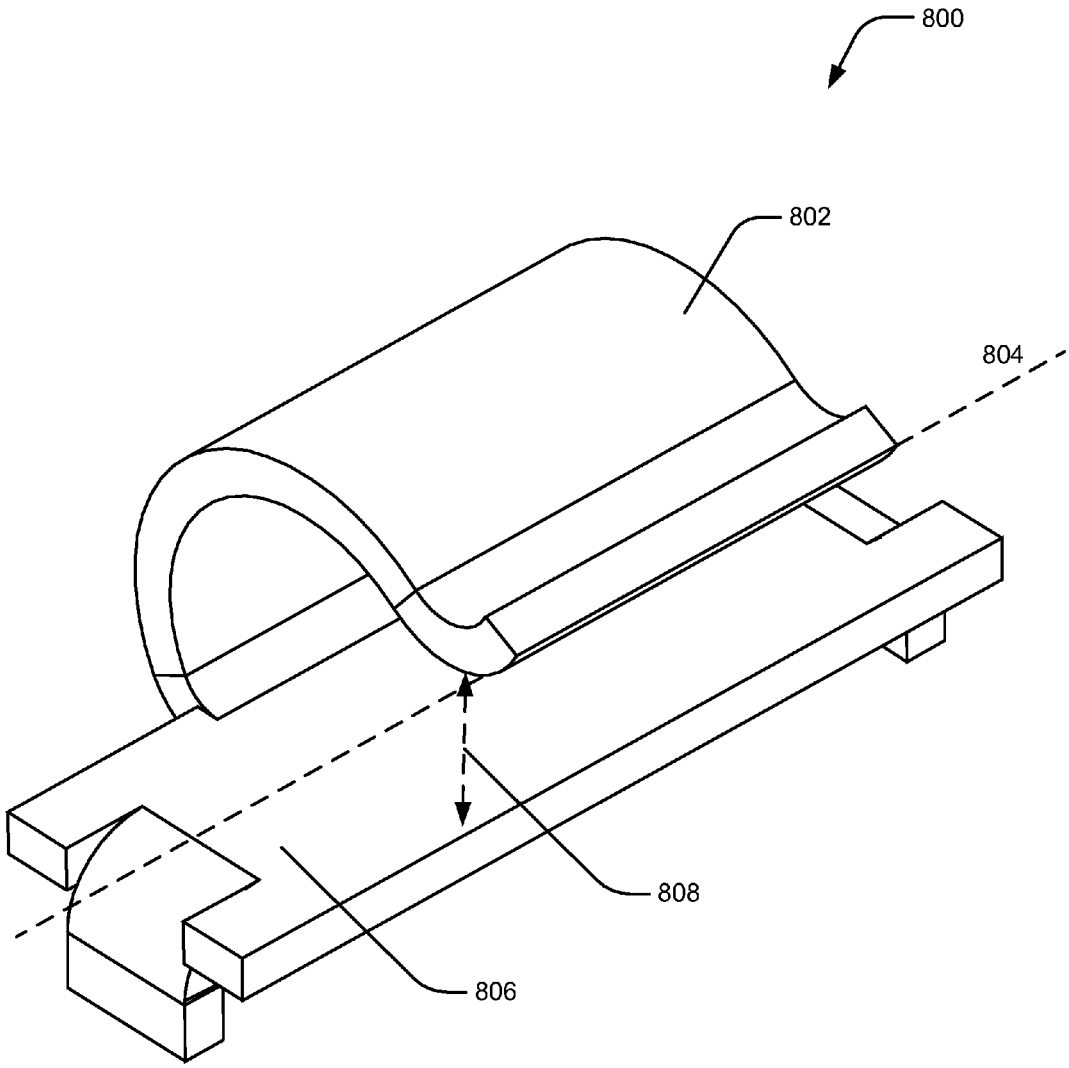
FIG. 8 shows another illustrative implementation of a clip which uses a curving surface to retain the sheath.

FIG. 8 shows another illustrative implementation of a clip 800 usable with a surface-mount grounding system. Clip 800 retains the sheath 102 using a curving surface 802 which originates at one side of the bottom surface parallel to a centerline 804 and arcs over the centerline of the bottom surface 806, with a radius of curvature approximately centered on the centerline 804. The curving surface 802 does not touch the side opposite its origination, defining a gap 808 on the opposing side for accepting the sheath 102. In this implementation, insertion of the sheath 102 occurs from a side of the clip 800. Thus, forces applied normal to the backplane will not readily dislodge the sheath 102.

Figure 9:
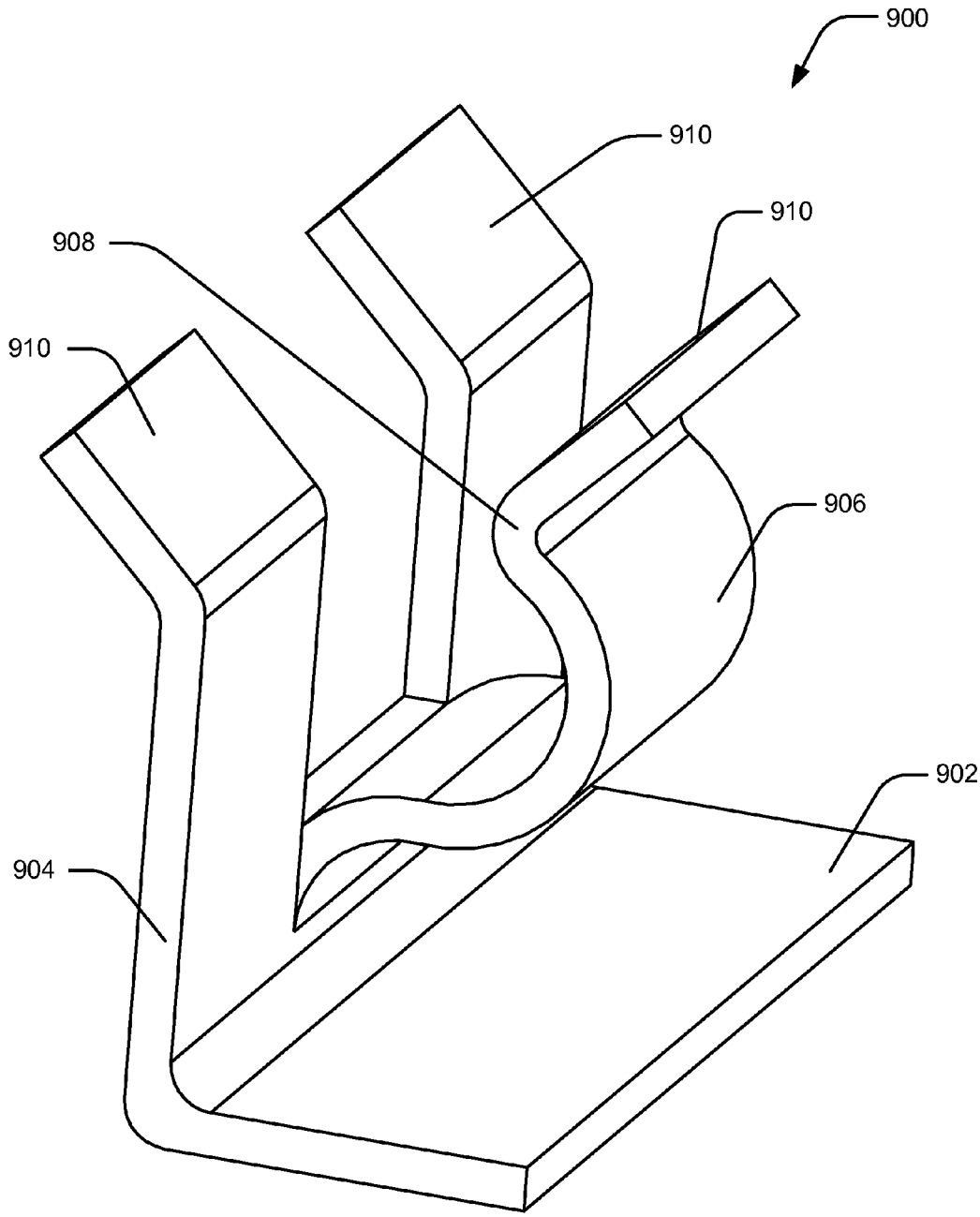
FIG. 9 shows another illustrative implementation of a clip with one side wall having a curving surface extending therefrom to retain the sheath.

FIG. 9 shows another illustrative implementation of a clip 900 usable with a surface-mount grounding system. Clip 900 has a rectangular bottom surface 902 and one substantially vertical side wall 904. A central portion 906 of vertical side wall 904 extends away from the vertical side wall and then back towards the vertical side wall in an arc, defining a gap at the top to accept sheath 102. A bend 908 on the distal end of the arcuate central portion 906 aids retention of the sheath 102 by making the gap smaller than the diameter of the sheath. The upper edges 910 of the side wall 904 and central portion 906 may angle away from the gap to facilitate placement of the sheath within the gap. By varying the placement of the central portion 906 on the vertical side wall, the sheath 102 and cable may be spaced from the backplane. This may be useful to electrically or thermally isolate the cable. Where electrical isolation is desired, the clip could be non-conducting and thus not act to ground the cable.

Figure 10:
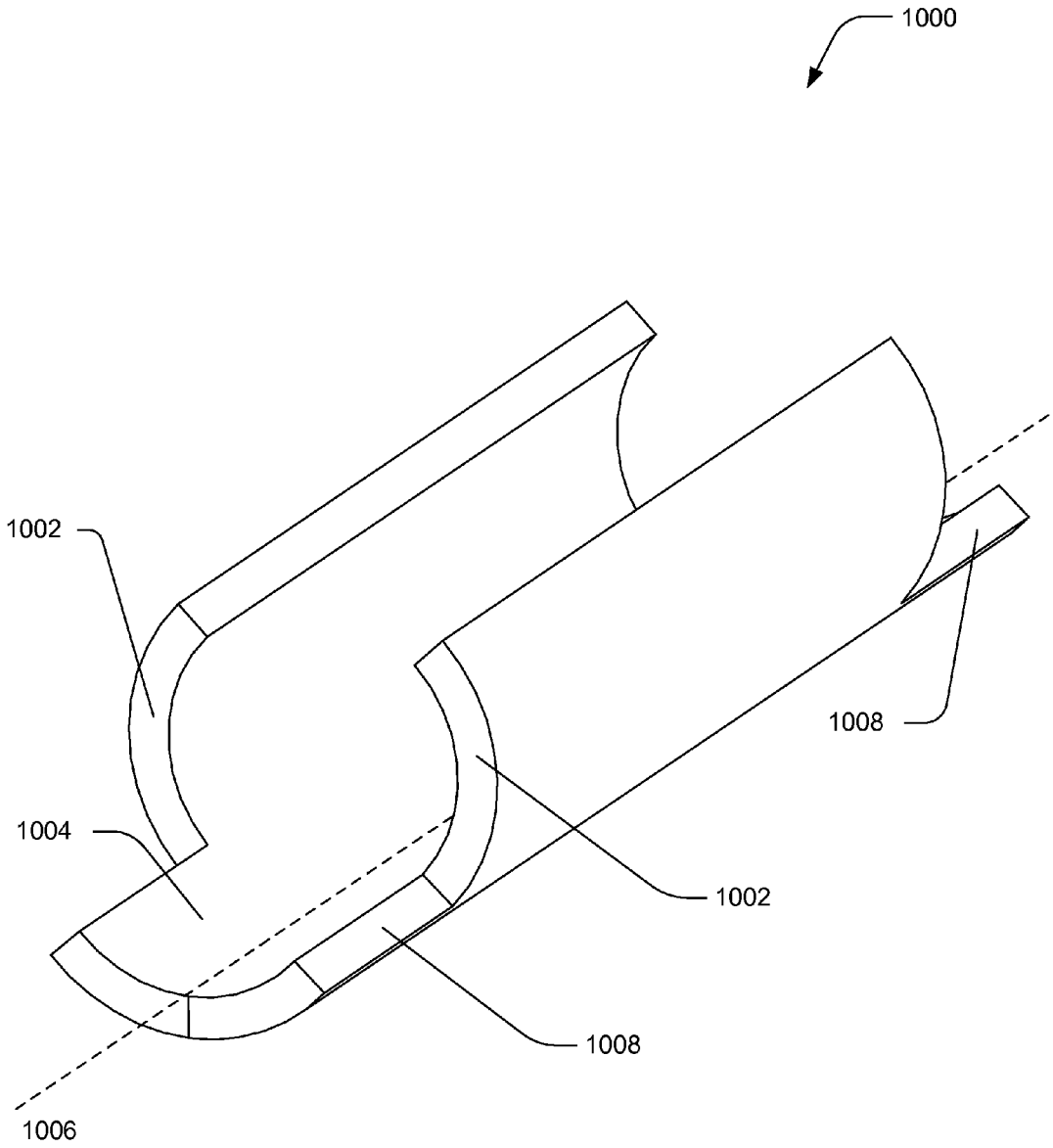
FIG. 10 shows another illustrative implementation of a clip with a generally circular cross section and defining a gap at the top to accept the sheath.

FIG. 10 shows another illustrative implementation of a clip 1000 usable with a surface-mount grounding system. Clip 1000 is generally circular in cross section, with arcuate sides 1002 extending upward from a bottom section 1004, defining a gap along the top centerline sized to accept sheath 102. The bottom surface 1004 may extend along centerline 1006 beyond the vertical edges of the arcuate sides 1002. Extensions 1008 provide for easier access when soldering or otherwise affixing the clip to the backplane.

Figure 11:
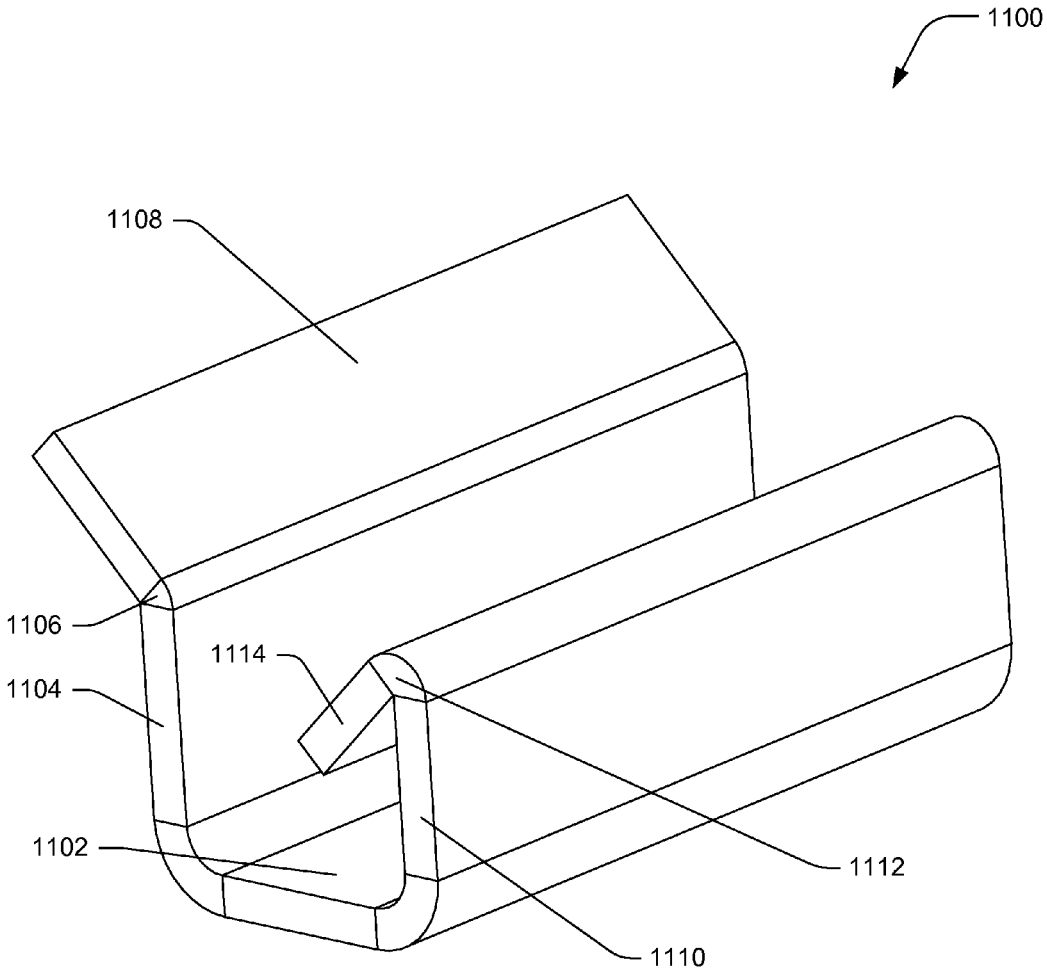
FIG. 11 shows still another illustrative implementation of a clip with two vertical side walls, one wall with a portion bent inward to act as a retention flange for the sheath, the other wall with a portion bent outward to aid insertion of the sheath.

FIG. 11 shows another illustrative implementation of a clip 1100 usable with a surface-mount grounding system. A bottom surface 1102 is rectangular with two side walls extending along its length. A left side wall 1104 extends vertically from the bottom surface 1102 upward to an outward bend 1106, where the wall is angled outward away from the centerline, forming top flange 1108. A right side wall 1110 extends vertically upward from the bottom surface 1102 to an inward bend 1112, where the right side wall 1110 bends down into the body of the clip 1100 towards the bottom surface 1102, forming retention flange 1114. The top flange 1108 and inward sloping retention flange 1114 direct the sheath 102 during insertion, while the retention flange 1114 retains the sheath 102 after engagement.

The sheath and the clip may be made by stamping, milling, molding, forming, or other methods of fabrication suitable to the material chosen. Moreover, the sheath and clips may be assembled to a backplane using manual and/or automated assembly techniques, such as pick-and-place machines, automated soldering processes, manual assembly, etc. Solder, adhesive, mechanical engagement, and the like, may affix the clip to the backplane and the clip to the coaxial cable. Any of the acts of any of the devices described herein may be implemented in a variety of materials or similar configurations.

Illustrative Manufacturing Method

Figure 12:
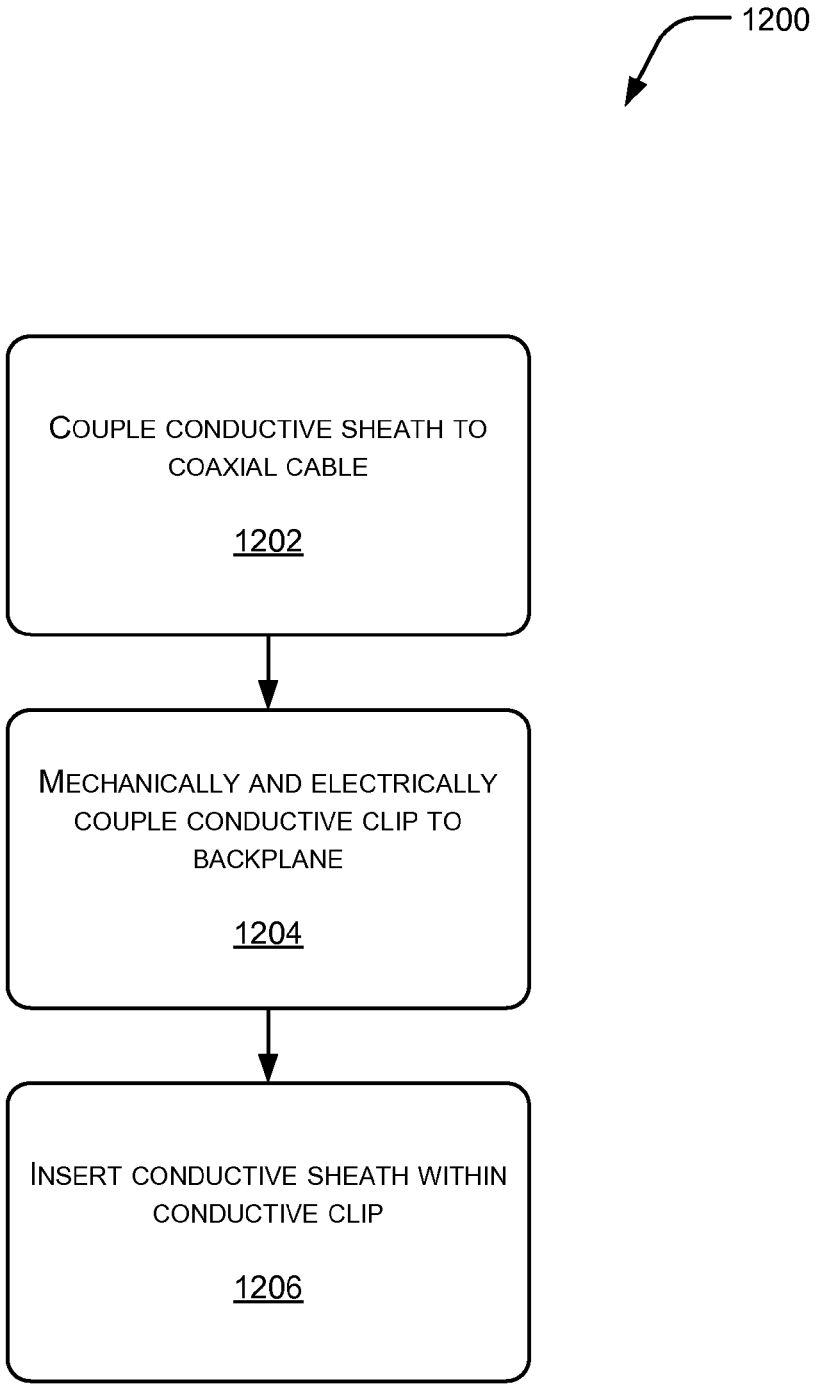
FIG. 12 shows an illustrative flowchart of a manufacturing method 1200.

FIG. 12 shows an illustrative flowchart of a manufacturing method 1200. At 1202 a conductive sheath is coupled to a coaxial cable. The coupling of the conductive sheath to the coaxial cable may be by crimping, latching, adhesive, etc. At 1204, a conductive clip is mechanically and electrically coupled to a backplane ground connection. Mechanically and electrically coupling the conductive clip to the backplane may comprise soldering the clip to the backplane, affixing the conductive clip using a conductive adhesive, an interference feature, etc. At 1206, the conductive sheath is inserted within the conductive clip.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims. For example, any of the devices described herein may be implemented using a variety of materials, or steps in the methods presented may be implemented in a variety of sequences.

What is claimed is:

1. A system for simultaneously routing and grounding coaxial cable on a printed circuit board, the system comprising:
- a metal sheath external to a coaxial cable, the sheath coupled electrically and mechanically to the coaxial cable with a protrusion configured to pierce or break an outer insulation of the coaxial cable and form an electrical pathway between the sheath and a shield of the coaxial cable;
- a clip coupled electrically and mechanically to the printed circuit board, the clip comprising:
  - a resilient metal;
  - a rectangular bottom surface having two sides and two ends;
  - a pair of side walls extending upward from the sides of the bottom surface;
  - an inward bend feature on each side wall defining a gap between a distal portion of the side walls that is less than a diameter of the sheath, thereby retaining the sheath within the side walls and engaging the sheath mechanically and electrically; and a pair of top flanges, each flange being substantially parallel to the bottom surface and extending away from an upper edge of the inward bend and wherein a total surface area of the top flanges is greater than a total surface area of the bottom surface.

2. The system of claim 1, wherein the resilient metal is a nickel silver alloy.

3. The system of claim 1, the conductive clip further comprising a mounting tab extending from each of the ends of the conductive clip.

4. A system comprising:

an insulated cable;

a sheath external to the cable and electrically and mechanically coupled to the insulated cable, wherein the sheath is conductive and is configured to pierce or break an outer insulation of the insulated cable and form an electrical pathway between the sheath and a shielding of the insulated cable;

a backplane; and a clip mechanically and electrically coupled to the backplane and configured to electrically and mechanically engage the sheath, the clip comprising:

a resilient and conductive material;

a substantially rectangular bottom surface coupled to the backplane;

a first side wall extending upward from an edge of the bottom surface and configured to retain the insulated cable and the sheath and establish an electrical connection with the sheath, and a top flange extending from the first side wall substantially parallel to the bottom surface and having a total surface area at least equal to a total surface area of the bottom surface.

5. The system of claim 4, wherein the resilient material comprises a metal or a polymer.

6. The system of claim 4, wherein the backplane comprises a printed circuit board.

7. The system of claim 4, further comprising a second side wall extending upward from an edge of the bottom surface opposite the first side wall and configured to retain the cable.

8. The system of claim 4, wherein the cable comprises coaxial cable.

9. The system of claim 4, wherein the sheath is substantially circular in cross section.

10. The system of claim 4, wherein the sheath has a substantially square or substantially rectangular cross section.

11. A clip for routing and grounding a cable on a backplane, the clip comprising:

a conductive body configured to accept a conductive sheath, the conductive sheath configured to electrically engage a portion of the cable, wherein the conductive sheath is external to the cable and configured to pierce or break an outer insulation of the cable and form an electrical pathway between the conductive sheath and a shield of the cable; and one or more top flanges coupled to the conductive body, the one or more top flanges combined having a total surface area at least equal to a total surface area of a bottom surface of the conductive body.

12. The clip of claim 11, wherein the conductive body further comprises:

a substantially rectangular bottom surface having two sides and two ends;

a pair of side walls extending upward substantially vertically from the sides of the bottom surface;

an inward bend on each side wall defining a gap between the distal portion of the side walls of less than a diameter of the cable thereby configured to retain the conductive sheath within the side walls and engage the conductive sheath mechanically and electrically; and the one or more top flanges, each flange being substantially parallel to the bottom surface and extending away from an upper edge of the inward bend.

13. The clip of claim 11, wherein the conductive body further comprises:

a substantially rectangular bottom surface having two sides and two ends;

a pair of side walls extending upward substantially vertically from the sides of the bottom surface, the walls being curved to match a profile of the conductive sheath and coupled to the one or more top flanges;

an inward bend on each side wall defining a gap between the distal portion of the side walls of less than a diameter of the cable, thereby configured to retain the conductive sheath within the side walls and engage the conductive sheath mechanically and electrically.

14. The clip of claim 11, wherein the conductive body comprises a polymer.

15. The clip of claim 11, wherein the conductive sheath has a substantially square or substantially rectangular cross section.

16. The clip of claim 11, further comprising tabs protruding from the conductive body for attachment to the backplane.

17. A method of routing and grounding a coaxial cable on a printed circuit board, the method comprising:

mechanically coupling a conductive sheath externally to a coaxial cable;

electrically coupling the conductive sheath to a shield of the coaxial cable via a protrusion configured to pierce or break an outer insulation of the coaxial cable and form an electrical pathway between the conductive sheath and the shield;

mechanically and electrically coupling a conductive clip to a backplane ground connection, wherein the conductive clip comprises one or more top flanges coupled to a conductive body, the one or more top flanges combined having a total surface area at least equal to a total surface area of a bottom surface of the conductive body; and inserting the conductive sheath within the conductive clip.

18. The method of claim 17, wherein mechanically and electrically coupling the conductive clip to the backplane comprises soldering the clip to the backplane.

19. The method of claim 17, wherein the electrically coupling the conductive sheath to the shield of the coaxial cable comprises crimping such that at least a portion of the conductive sheath pierces an outer insulation layer of the coaxial cable and contacts at least a portion of the shield.

20. The method of claim 17, further comprising coupling a plurality of conductive clips to a backplane to define a cable routing path.

21. The method of claim 17, wherein the coaxial cable couples a radio frequency module to an antenna.

* * * * *